US005370231A

United States Patent [19]

Nieto

[11] Patent Number: 5,370,231

[45] Date of Patent: Dec. 6, 1994

[54] MODULAR THEFT-PROTECTED DISPLAY CASE FOR RINGS

[76] Inventor: D. Carlos F. Nieto, Pl. Independence, 5, Madrid, Spain

[21] Appl. No.: 69,363

[22] Filed: Jun. 1, 1993

[30] Foreign Application Priority Data

May 17, 1993 [ES] Spain ..... 9300711

[51] Int. Cl.[5] ..... B65D 1/34

[52] U.S. Cl. ..... 206/566; 206/6.1; 206/560; 211/4

[58] Field of Search ..... 206/6.1, 560, 564, 566; 211/4, 7

[56] References Cited

U.S. PATENT DOCUMENTS

| | | | |
|---|---|---|---|
| 504,167 | 8/1893 | Krueger | 206/560 |
| 672,561 | 4/1901 | Leob | 206/560 |
| 732,089 | 6/1903 | Lenzen | 206/566 |
| 1,063,662 | 6/1913 | Dahl | 206/560 |
| 1,994,363 | 3/1935 | Kettendorf | 206/560 |
| 3,204,774 | 9/1965 | Barbieri | 206/562 |
| 3,964,603 | 6/1976 | Sandler | 206/566 |
| 4,074,637 | 2/1978 | Lorenzen, Jr. | 206/566 |
| 4,511,041 | 4/1985 | Waitzmann | 206/560 |

*Primary Examiner*—David T. Fidei

*Attorney, Agent, or Firm*—Larson and Taylor

[57] ABSTRACT

A modular theft-protected display case for rings permits handling and trying-on of a ring which is secured by a strong metallic cord, riveted at the ends which are placed in the axial perforation in a counterweight placed in coinciding grooves which make it impossible to remove the ring from the display case. Rings are situated in openings on a cover of a hollow case. Underneath these holes, inside the case, is a set of strips, each having a vertical line of holes aligned with openings on the cover. These holes have slits at the bottom through which the cord passes. The slits of the holes prevents the ring from being removed either upward, due to the counterweight or downward, due to the ring itself. A separate spring biases each strip to this non-removal position. Each strip has a contacting portion for moving the strip out of its biased position in order to allow a ring to fall through a hole and within the hollow case. This contacting portion is accessible through the back of the case.

5 Claims, 2 Drawing Sheets

MODULAR THEFT-PROTECTED DISPLAY CASE FOR RINGS

FIELD OF THE INVENTION

This invention refers to a "modular theft-protected display case for rings" which is made of hard plastics or the like and which can be adapted to the market requirements of each case with the use of different modules in the dimensions required, and which has a simple theft-protection device of proven efficacy.

BACKGROUND OF THE INVENTION

Until now, the sale of rings has involved serious difficulties because of the ease with which they can be removed, particularly in department stores, since such sales are public and the potential buyer must have access in order to the try a ring on, all of which makes it possible to remove them. In an attempt to counteract this danger, staff must employ very direct surveillance, thereby raising the cost of sales personnel without offering a high percentage of security against possible theft.

There are at present display cases with security devices which do not allow the public access to try a ring, so that one sales employee must at all times be dedicated to each customer.

SUMMARY OF THE INVENTION

In order to improve this situation, the present invention has been created to permit easy public access to the ring, in order to try a variety of sizes on, thereby enhancing sales while at the same time providing each ring with an effective theft-protection device.

The benefits of this invention are revealed by the enclosed specifications, although some are hereby referred to, by way of illustration and without limitation, as follows:

1) A variety of modules can be adapted to the size requirements of the market in each particular case.
2) Free public access to the ring, in order to try different sizes.
3) An effective theft-protection device which, as pointed out, enables a potential buyer to handle the ring.

BRIEF DESCRIPTION OF THE DRAWINGS

For a better understanding of these specifications, the attached drawings are included to show a possible design, without limitation, of the subject of this invention, and in which.

DETAILED DESCRIPTION OF THE PREFERRED EMBODIMENT

Figure 1:
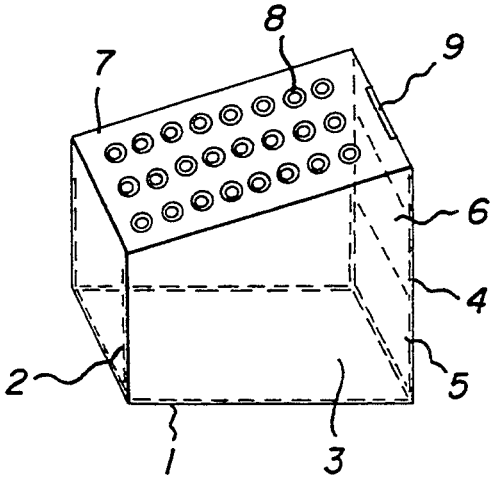
FIG. 1 is a perspective view of a module of the display case.

According to these designs, the display case is made up of hollow modules (1) with a rectangular base with a perimeter rib (2) inside. The longer sides (3) of said module are trapezoid-shaped, while the cover and shorter sides are rectangular. The inside vertical edges of the shorter side have strengtheners formed by square shafts backed into the inside of said corners. There are similar strengtheners on the opposite side which are a flatter rectangle and which serve at the same time as support and as the sliding surface for the intermediate part on that side.

The back side is made up of two horizontal components, the lower first component (5) secures the module and the intermediate second component (6) slides while the upper portion of the backside is hollow so that the ring can be handled and removed. This upper portion may be partly covered as is explained below.

The cover (7) is made up of a smooth rectangle in which there are a number of parallel rows of openings with a shortened-cone mouth (8) at the bottom of which there is a groove. The top of the cover (7) has a protruding square (9) secured on said cover by two side dowels so as to form a "V" window between the cover and the square which is adapted to accommodate advertising signs. The different ring sizes can be placed horizontally in the openings on the cover.

Inside the cover there is a stop (10) on which the semi-circular heads (11) of the ring-holder strips (12) are supported.

Said strips (12) are stretched rectangular shapes with a vertical row of round holes (13) with a slit (14) in the bottom through to the inside of said hole. These holes (13) are aligned with the smaller diameter holes (8) in the cover. The strips (12) end at the side opposite the head (10) in a small central groove (15).

These strips slide between double guides (16) on both sides of which there are two adjacent U-shaped recesses on which the strips slide.

The heads (11) of the strips (12) are semi-circular and are at right angles to the strip so that when the cover fitted on to the module (1), the heads (11) of the strips (10) are placed vertically downward in relation to the cover and can be handled through the rear hollow of the module, providing a grip for their handling.

Figure 4:
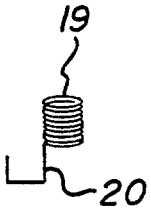
FIG. 4 shows the spring securing the ring strip.
Figure 5:
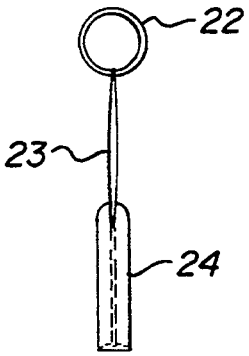
FIG. 5 is a view of the ring with its safety device.
Figure 6:
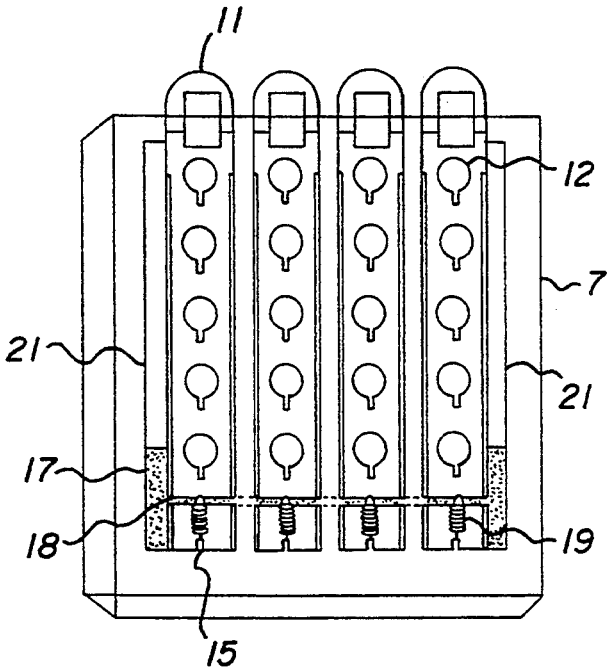
FIG. 6 is a frontal view of the inside of the display case cover with the ring-holder strips and their safety device.
Figure 7:
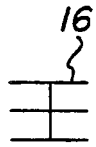
FIG. 7 is a cross-section of the guides on which the ring-holder strips slide.
Figure 8A:
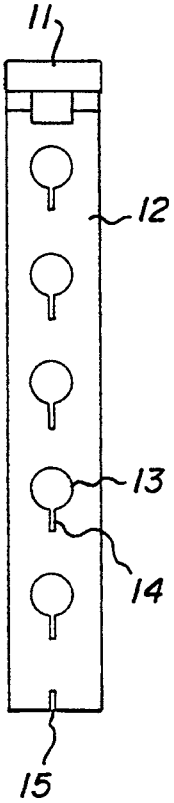
FIG. 8*a* is a front view of the ring-holder strip.
Figure 8B:
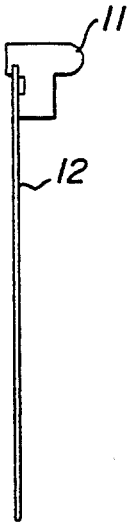
FIG. 8*b* is a side view of the ring holder strip.

On the side opposite the heads (11), under the last round hole, the guides (16) have a rectangular larger section (17) with holes through the inside and in which a shaft (18) slips on to which the upper circles of a spring (19) are inserted, ending in a "U" shape (20) as shown in FIG. 4 the free end of which is secured in the groove (15) at the end of each ring-holder strip. In this way, when the head (11) of the strip (12) is pressed, the spring (19) and safety device fixed to the ring shown in FIG. 5, are compressed, passing through the slits in each circle into the interior from where it can be removed.

Figure 9:
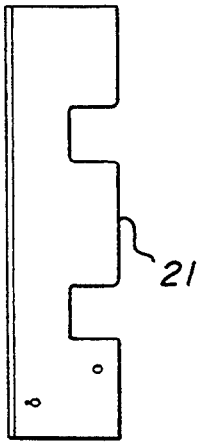
FIG. 9 shows the side stops on the ring-holder bands where the shaft connecting the different bands is secured.
Figure 10:
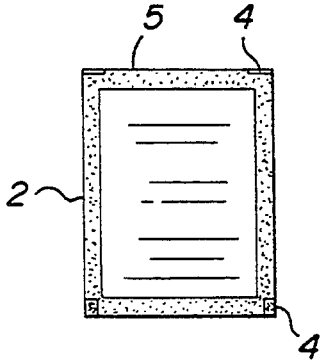
FIG. 10 is a face view of the base of the module with the vertical strengtheners on its corners.

The transversal shaft (18) is fixed laterally on two inside components (FIG. 9) which are at right angles to the inside surface of the cover, formed by two rectangular plates (21) each having two symmetrical U-shaped openings facing the bottom of the display case. One of these plates (21) is shown in FIG. 9. The plates can be fixed inside the cover (7) or may slide on guides (16).

The rings (22) adapt exactly to the concave form of the holes (8) in the display case cover, and are secured by a high-strength metal cord (23) the ends of which are riveted together and inserted in a counterweight (24) perforated along its vertical axis. Said cord passes through the slip in the bottom of the holes (8) and then fits into the slits (14) in the round holes in the ring-holder strips. The counterweight (24) keeps the ring vertical.

This cord enables a potential buyer to handle and try the ring, but prevents it from being removed because it is fitted into the vertical slits (12) on the circles (13) in the ring-holder strips (12), until the vendor moves the head (11) of said strip (12).

Figure 2:
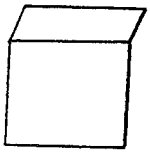
FIG. 2 is a frontal view of a transparent strip which partially covers the opening for handling the ring-holder bands.
Figure 3:
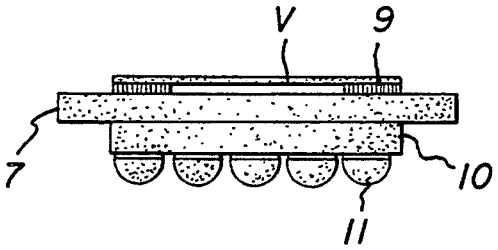
FIG. 3 is a top side view of the display case cover.

The top rear space in the display case can be partly covered by the transparent strip (FIG. 2), which forms a right angle so that the shorter side fits into the V-shaped opening on the side of the cover and the longer side partially covers the hollow provided for handling.

The various parts which are not fixed in place are screwed together: moreover, a number of modules can likewise be screwed together.

Finally, following the description given, it remains only to be pointed out that this invention can admit any possible design variations without altering its essential nature as described, and may be manufactured in all shapes, sizes and materials, without limitation. It will be understood by those skilled in the art that variations and modifications may be effected in these embodiments without departing from the scope and spirit defined in the claims which follow.

I claim:

1. A modular theft-protected display case for rings comprising:

a hollow case of rectangular base, longer sides of which are trapezoid-shaped, and whose rear vertical face has three horizontal sections, a bottom section being fixed, a middle section being slidable and a top section being hollow;

a cover for covering said hollow case including a series of vertical lines of openings whose external perimeter is a shortened-cone shape and having a slit at the bottom;

a set of rectangular strips having round vertical holes aligned with said openings in said cover and which have slits extending from the bottom of said holes, said strips further including a means for contacting said strip at an end nearest said rear vertical face of said hollow case and, on an opposite end, a small central groove;

a shaft;

two-sided vertical guides, supported in said hollow case and in which said strips slide, which widen in a zone opposite said contacting means through which said shaft is passed into said case;

a set of springs, each spring being associated with one of said strips, attached at one end to said shaft and at an opposite end to said small central groove of an associated strip; and two fixed rectangular bands, each with symmetrical U-shaped openings for holding said shaft, disposed on the inside of said cover on opposite sides of said set of strips.

2. A modular theft-protected display case for rings as set forth in claim 1, wherein the rectangular bands inside the cover slide on a guide.

3. A modular theft-protected display case for rings as set for in claim 1, wherein the top rear space in the display case can be partly covered by a strip having a right angle, a short side of which is inserted in a U-shaped opening between an outside surface of said cover and a band forming a recess on said cover and supported on said cover only at its ends.

4. A modular theft-protected display case for rings as set forth in claim 1, wherein said ring is placed on a metal cord to be inserted through one of said slits or a strip, ends of said cord being placed in an axial vertical opening of a counterweight to hang below said strips and being riveted together.

5. A modular theft-protected display case for rings as set forth in claim 1, wherein edges of said hollow case are strengthened by internal posts.

* * * * *